US005843246A

United States Patent [19]

Kim et al.

[11] Patent Number: 5,843,246

[45] Date of Patent: Dec. 1, 1998

[54] PROCESS FOR PRODUCING DUAL PHASE FERRITIC STAINLESS STEEL STRIP

[75] Inventors: Yeong-U Kim, Export; Lewis L. Kish, Sarver, both of Pa.

[73] Assignee: Allegheny Ludlum Corporation, Pittsburgh, Pa.

[21] Appl. No.: 586,452

[22] Filed: Jan. 16, 1996

[51] Int. Cl.[6] ..... C21D 6/00

[52] U.S. Cl. ..... 148/607; 148/661; 148/605

[58] Field of Search ..... 148/67, 605, 610, 148/661, 325

[56] References Cited

U.S. PATENT DOCUMENTS

| | | | |
|---|---|---|---|
| 3,723,194 | 3/1973 | Hultgren et al. | 148/564 |
| 4,141,762 | 2/1979 | Yamaguchi et al. | 148/37 |
| 4,812,176 | 3/1989 | Tanaka et al. | 148/610 |
| 4,824,536 | 4/1989 | Kim et al. | 294/145 |
| 5,178,693 | 1/1993 | Miyakusu et al. | 148/607 |
| 5,307,864 | 5/1994 | Arvedi et al. | 164/476 |

*Primary Examiner*—Deborah Yee

*Attorney, Agent, or Firm*—Patrick J. Viccaro; Robert J. Pugh

[57] ABSTRACT

A method for producing a dual phase ferrite-martensite steel product from a cold rolled stainless steel. The method includes a step of rapidly heating the steel to annealing temperature in less than 30 seconds, followed by a step of cooling the heated steel at a cooling rate sufficient to transform austenite to martensite.

11 Claims, 4 Drawing Sheets

PROCESS FOR PRODUCING DUAL PHASE FERRITIC STAINLESS STEEL STRIP

BACKGROUND OF THE INVENTION

1. Field of the Invention

The present invention relates to a method for producing a fine grain dual phase ferritic-martensitic stainless steel sheet or strip having superior tensile strength and Vickers hardness relative to conventionally produced sheet or strip, and which is produced using a step of rapid heating to an annealing temperature, followed by cooling at a rate sufficient to transform austenite to martensite. The present invention more particularly relates to a method for producing a dual phase ferritic-martensitic stainless steel sheet or strip and having a generally uniform fine grain size by rapidly annealing the sheet or strip to a temperature in the range of 1900°–2250° F. (1038°–1232° C.) and cooling the sheet or strip at a cooling rate sufficient to transform austenite to martensite.

2. Description of the Invention Background

The desirable combination of favorable mechanical and formability properties of dual phase ferritic-martensitic stainless steel strip is well known to specialty steel producers, and the steel's properties are utilized to advantage by steel producer's customers. In recent years, dual phase ferritic-martensitic stainless steel strip is being used increasingly in the electronics industry and, in particular, in computer manufacturing applications. With the proliferation of businesses in the electronics industry, there is an increasing demand for dual phase ferritic-martensitic stainless steel sheet or strip, and for such sheet or strip having improved hardness, yield and tensile strength and elongation properties, along with improved formability properties that are not supplied consistently by currently available dual phase ferritic stainless steels processed by conventional techniques.

Accordingly, an object of the present invention is to provide a method for producing a dual phase ferritic-martensitic stainless steel sheet or strip having mechanical properties superior to those obtained using conventional processing techniques. An additional object of the present invention is to provide a method for producing a dual phase ferritic-martensitic stainless steel sheet or strip having such desirable mechanical properties and which may be carried out quickly so as to decrease the annealing time and shorten the length of the annealing equipment and the overall line length.

SUMMARY OF THE INVENTION

The above objectives are satisfied by the rapid annealing method of the present invention that is schematically illustrated in FIG. 1, wherein in a first step a cold rolled stainless steel, preferably in the form of a sheet or strip, is processed by heating to an annealing temperature in less than 30 seconds. In a second step, the heated steel is cooled at a cooling rate sufficient to transform austenite in the steel into martensite to provide a dual phase product essentially of ferrite and martensite. As demonstrated in the detailed description of the preferred embodiment set out below, dual phase ferrite-martensite stainless steel produced by the rapid annealing method of the present invention exhibits increased tensile strength and hardness relative to conventionally produced stainless steel sheet or strip consisting of a dual phase of ferrite and martensite and without any significant adverse effect to the steel's yield strength and elongation.

To better provide enhanced tensile strength and hardness properties to the dual phase steel produced by the present method, it is preferred that the cold rolled stainless steel is heated to annealing temperature in less than 30 seconds, and it is also preferred to employ transverse flux induction heating ("TFIH") to rapidly heat the steel to annealing temperature. Preferably, the annealing temperature to which the steel is rapidly heated is within the range of 1900° F. (1038° C.) to 2250° F. (1232° C.), which temperature is reached within some finite time less than 30 seconds, and preferably less than ten seconds. In a preferred embodiment, the steel may be heated to temperature at heating rates of at least 200° F. per second (111° C./sec). In a most preferred embodiment, the cold rolled steel is subjected to the cooling step of the present method immediately after reaching the annealing temperature.

The method preferably is applied to the stainless steels of the AISI Type 400 series, and is more preferably applied to ferritic chromium stainless steels, including Type 430 chromium stainless steel. In a preferred embodiment, the method of the present invention is applied to cold rolled AISI Type 430 steel, preferably in the form of a sheet or strip, to provide a dual phase ferrite-martensite product. It has been found that a superior dual phase product results by processing cold rolled T-430 steel by rapidly annealing the steel to an annealing temperature in the range of 1900° F. (1038° C.) to 2250° F. (1232° C.) in a time-to-temperature ("TTT") of less than 10 seconds, and then cooling, preferably in ambient air, immediately after the annealing temperature is reached to transform austenite to martensite. By using the present invention's method to process cold rolled T-430 strip, a dual phase ferrite-martensite steel may be produced having a uniform ASTM 8–9 grain size comprising about 30% to 40% martensite, and having approximately 220–270 Vickers Hardness and approximately 110–120 ksi (758.4–827.3 MPa) tensile strength. These properties are superior to the hardness and tensile strength of dual phase ferrite-martensite product produced by conventionally annealing T-430 steel using gas-fired or electrical resistance-heated furnaces. Also, the enhanced tensile strength and hardness of the rapidly annealed product result without any significant change in the yield strength or elongation properties relative to the conventionally-processed product. Because the rapid annealing method is carried out in less time per lineal distance on the sheet or strip relative to a conventional anneal, increased throughput of the annealing line may result if other equipment on the line can be increased in speed.

These features and other advantages of the present invention will be apparent and more fully understood on consideration of the detailed description of the preferred embodiment discussed below and in light of the following figures.

DETAILED DESCRIPTION OF THE PREFERRED EMBODIMENT

Figure 1:
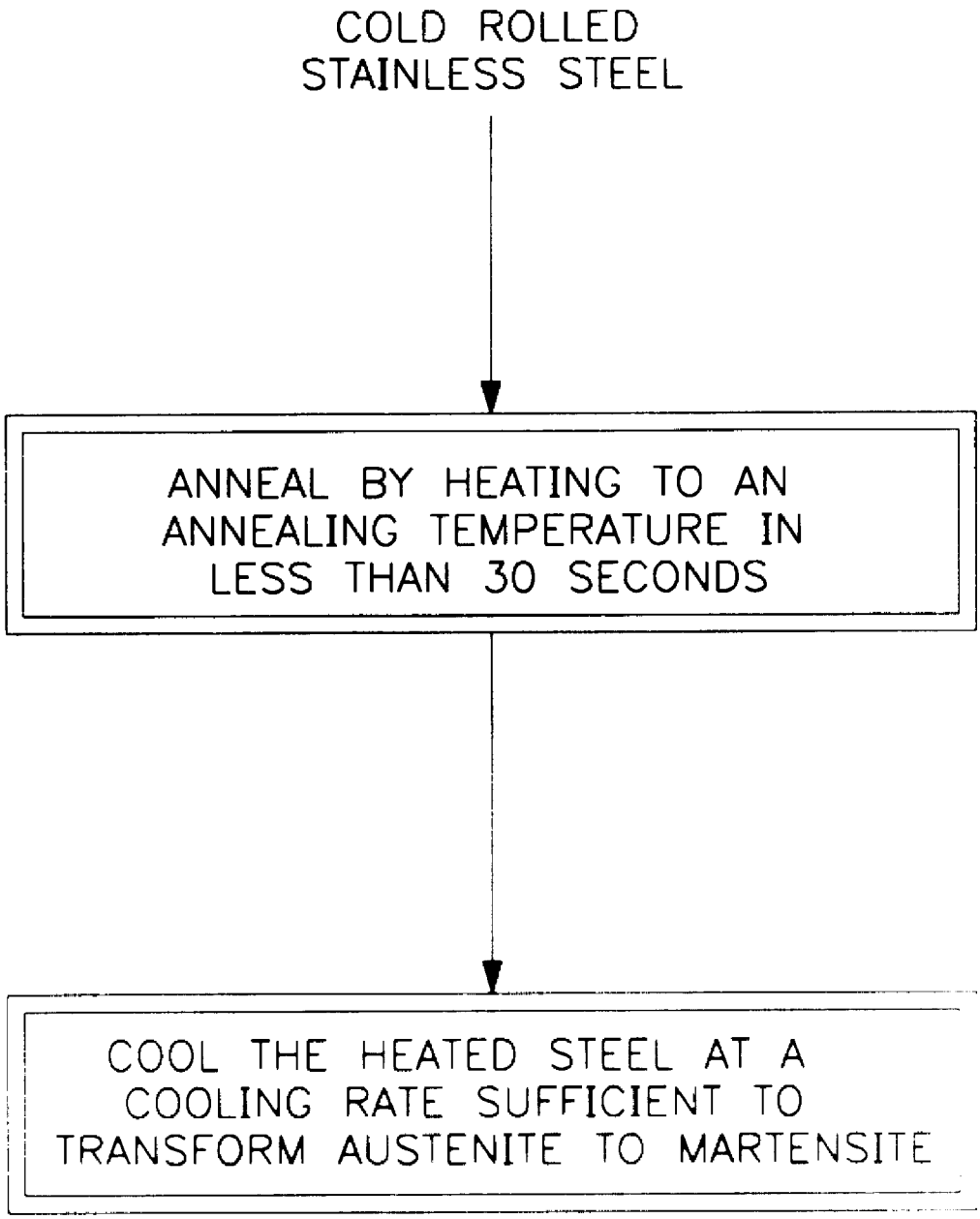
FIG. 1 is a schematic illustration of the method of the present invention for producing dual phase ferritic-martensitic sheet or strip.

The present invention is directed broadly to a rapid annealing method, shown schematically in FIG. 1, for the production of stainless steel sheet or strip composed of a dual phase of ferrite and martensite. The steel may comprise, in weight percent, about 10 to 20 chromium, up to 0.30 carbon, up to 1.0 manganese, up to 1.0 silicon, up to 1.5 molybdenum and the balance iron and normal steelmaking residual impurities.

EXAMPLE 1

Eighteen 2" wide×11" long (5.08×27.94 cm) samples of a 0.0118" (0.2997 cm) thick strip of cold-rolled (56% cold reduction) AISI Type 430 steel were prepared. The T-430 steel had the laboratory chemistry provided in Table 1. The composition in Table 1 is provided in weight percentages of the total weight of the alloy.

TABLE 1

| Element | Weight Percentage |
|---|---|
| C | 0.047 |
| P | 0.021 |
| Si | 0.620 |
| Ni | 0.34 |
| Cu | 0.061 |
| Sn | 0.005 |
| B | 0.0005 |
| Ti | 0.002 |
| Mn | 0.450 |
| S | 0.0008 |
| Cr | 16.31 |
| Mo | 0.046 |
| N | 0.037 |
| Pb | 0.0004 |
| Al | 0.002 |
| V | 0.080 |
| Co | 0.026 |
| Cb | 0.009 |

The eighteen samples of the cold rolled T-430 were rapidly annealed at very fast times-to-temperature to simulate transverse flux induction heating. In TFIH, the strip is heated almost linearly with time up to peak annealing temperatures as it passes through an inductor. The strip then would be cooled by radiation and convection as it exits the inductor. TFIH was selected to rapidly anneal the samples, in part, because cold rolled strip may be heated to the required annealing temperature at heating rates of at least 200° F. per second (111° C./sec) and up to 1050° F. per second (583° C./sec), if desired. It is believed that the rapid heating rate provided by TFIH leaves little time for the growth of nucleated austenite grains. The inventors have found that stainless steel strips rapidly annealed by TFIH typically display a fine and uniform grain size. It is expected that fine and uniform grain sizes will result in significantly reduced planar anisotropy to provide improved formability. It is believed that larger grain sizes may be provided, if desired, by selecting higher annealing temperatures.

As used herein for the ASTM grain sizes, the larger numbers refer to finer grain sizes.

The process of heating metal strip by TFIH is known to those of ordinary skill in the art and is illustrated by, for example, U.S. Pat. Nos. 4,054,770, 4,585,916, 3,444,346, 2,902,572, 4,678,883, and 4,824,536. The actual heating rate that will be achieved using TFIH will depend on the design and operating parameters of the inductor, including the inductor power rating, aim temperature, strip thickness and line speed. For the purposes of the present invention and disclosure it may be taken that it is within the skill of the art to select an appropriate combination of impressed frequency and power, together with suitable use of shielding and shaping of the inductor's polepieces in order to achieve, at a selected rate of throughput, a satisfactory heating of the stainless steel strip or sheet to a desired anneal temperature, with the avoidance of the generation of uneven temperatures across the width of the strip such as might cause cobbling, buckling, or other undesired effects.

Although the present preferred embodiment utilizes TFIH to provide rapid annealing of the stainless steel samples, it will be understood that any alternate means may be employed in the process of the present invention by which the sheet or strip may be rapidly heated in times less than about 30 seconds to an annealing temperature at which austenite forms. It is believed that such alternate means of rapid annealing may include longitudinal or solenoidal induction heating, direct resistance heating, and high radio frequency heating.

To provide an accurate simulation of annealing of full-size strip by TFIH, a Gleeble 2000TS Thermal System, distributed by Dynamic Systems, Inc. of Poestenkill, N.Y. was used to heat the samples to the annealing temperatures. The Gleeble system allowed the samples to be annealed under varying conditions using a constant heating rate up to aim temperature and with cooling of the heated strip by radiation and air convection. Following the established procedure for the Gleeble system, the eighteen T-430 strip samples were annealed to aim temperatures of 1900® F. (1038° C.), 1950° F. (1066° C.), 2000° F. (1093° C.), 2050° F. (1121° C.), 2100° F. (1149° C.) and 2150° F. (1177° C.) at heating rates providing a TTT of either 2, 4 or 8 seconds for each aim temperature. After reaching peak temperatures, the heated samples were immediately air cooled and were subsequently processed for metallographic examination and mechanical testing.

Because the heating rates used to simulate TFIH annealing on the Gleeble system were very high compared with those of typical annealing cycle simulations run on the Gleeble system, extremely high power input was required. Despite numerous runs of trial-and-error to appropriately adjust the Gleeble system's cycle program and power settings to provide precise TFIH anneal cycle simulation, precise control of the peak temperature of each run was somewhat difficult to achieve. To determine the true peak temperature of the sample, the data acquisition feature of the Gleeble system was utilized and the true peak temperature was recorded from the collected data. Despite some difficulty in hitting precisely the aim anneal temperature, the true peak temperature of each run was very close to the aim temperature. In each run, the sample was cooled immediately after reaching the indicated peak temperature.

Table 2 provides the aim temperature, actual peak temperature, TTT and metallographic and mechanical properties for the eighteen samples of one coil of T-430 sheet rapidly annealed using the Gleeble system. Yield strength, ultimate tensile strength and elongation were all determined in the longitudinal direction.

As shown in Table 2, the yield strength ranged from 56.4 to 61.3 ksi (388.86 to 422.65 MPa) and the ultimate tensile strength ranged from 112.9 to 119.3 ksi (778.42 to 822.54 MPa) over the actual peak temperature range of 1899° to 2150° F. (1037° to 1177° C.).

The percent martensite was determined by a method known to those skilled in the art, namely by visual estimation. The visual estimate was made through a Nikon brand metallograph that can operate in the range of 100X to 1000X magnification depending upon the strip gauge and extent of martensite in the structure.

TABLE 2

| Sample No. | Aim Temp. (°F.) | Actual Peak Temp.(°F.) | TTT (sec) | Grain Size (ASTM) | Martensite (%) | Hardness, VHN 1 | 2 | 3 | Ave. | YS (ksi) | UTS (ksi) | Elong (%) | E ($10^6$) |
|---|---|---|---|---|---|---|---|---|---|---|---|---|---|
| 1 | 1900 | 1912 | 2 | 9 | 40 | 260.0 | 238.0 | 275.5 | 257.8 | 56.4 | 112.9 | 20.0 | 27.7 |
| 2 | 1900 | 1914 | 4 | 9 | 40 | 259.5 | 274.5 | 264.0 | 266.0 | 58.2 | 114.4 | 17.0 | 27.1 |
| 3 | 1900 | 1899 | 8 | 9 | 40 | 251.0 | 258.5 | 259.5 | 256.3 | 58.6 | 114.9 | 18.0 | 27.1 |
| 4 | 1950 | 1948 | 2 | 9 | 40 | 248.0 | 258.5 | 263.0 | 256.5 | 61.0 | 117.4 | 17.5 | 28.4 |
| 5 | 1950 | 1948 | 4 | 9 | 40 | 246.0 | 242.0 | 244.0 | 244.0 | 59.2 | 116.7 | 17.5 | 27.9 |
| 6 | 1950 | 1947 | 8 | 9 | 40 | 247.0 | 239.0 | 240.0 | 242.0 | 59.8 | 116.7 | 18.5 | 28.4 |
| 7 | 2000 | 2002 | 2 | 9 | 40 | 228.0 | 230.0 | 236.0 | 231.3 | 59.6 | 117.6 | 16.5 | 28.7 |
| 8 | 2000 | 2004 | 4 | 9 | 40 | 241.0 | 230.0 | 229.0 | 233.3 | 60.6 | 118.3 | 18.0 | 27.5 |
| 9 | 2000 | 1990 | 8 | 9 | 40 | 269.0 | 266.0 | 270.0 | 268.3 | 61.0 | 119.3 | 17.5 | 28.6 |
| 10 | 2050 | 2042 | 2 | 9 | 40 | 245.5 | 245.5 | 258.5 | 249.8 | 61.0 | 117.9 | 18.0 | 27.5 |
| 11 | 2050 | 2048 | 4 | 9 | 40 | 247.0 | 257.0 | 253.0 | 252.3 | 61.2 | 119.2 | 18.5 | 27.2 |
| 12 | 2050 | 2062 | 8 | 9 | 40 | 244.0 | 248.0 | 259.0 | 250.3 | 61.3 | 119.0 | 18.0 | 28.7 |
| 13 | 2100 | 2087 | 2 | 9 | 40 | 222.0 | 232.0 | 233.0 | 229.0 | 58.9 | 117.0 | 16.5 | 27.5 |
| 14 | 2100 | 2101 | 4 | 9 | 40 | 247.0 | 246.0 | 242.0 | 245.0 | 60.3 | 118.3 | 19.0 | 27.9 |
| 15 | 2100 | 2112 | 8 | 9 | 40 | 241.0 | 238.0 | 243.0 | 240.7 | 61.0 | 118.5 | 17.5 | 27.8 |
| 16 | 2150 | 2148 | 2 | 9 | 40 | 238.0 | 247.0 | 233.0 | 239.3 | 59.4 | 117.9 | 16.5 | 29.0 |
| 17 | 2150 | 2144 | 4 | 9 | 40 | 239.0 | 235.0 | 245.0 | 239.7 | 60.2 | 119.2 | 17.5 | 29.4 |
| 18 | 2150 | 2150 | 8 | 9 | 40 | 232.0 | 232.0 | 231.0 | 231.7 | 60.4 | 118.0 | 17.0 | 28.7 |

As a basis for comparing the grain size and mechanical properties of samples 1–18 to conventionally processed dual phase strip, Table 3 provides statistics on the properties of 343 different coils of dual phase ferritic-martensitic Type 430 steel produced in a conventional manner. That the coils of dual phase material were produced in a conventional manner is intended to mean that subsequent to cold rolling, the steel strip was heat treated to produce austenite using a continuous annealing operation in a gas-fired or electrical resistance-heated, refractory-lined furnace, which heats the steel strip to annealing temperature in approximately 20 to 30 seconds. The conventionally processed dual phase Type 430 stainless steel typically was annealed at 1875° F. (1024° C.) and then cooled by a jet blast of inert gas to form martensite.

TABLE 3

| | No. of Samples | Mean | Standard Deviation | Min. | Max. |
|---|---|---|---|---|---|
| Grain Size (ASTM) | 343 | 7.9 | 0.4 | 6.0 | 9.0 |
| Hardness (VHN) | 343 | 221.4 | 8.7 | 210.0 | 244.0 |
| Yield Strength (ksi) | 343 | 61.4 | 4.9 | 48.5 | 79.0 |
| UTS (ksi) | 343 | 91.6 | 3.8 | 80.0 | 104.5 |
| Elongation % | 343 | 18.51 | 1.9 | 9.5 | 26.0 |

Figure 2:
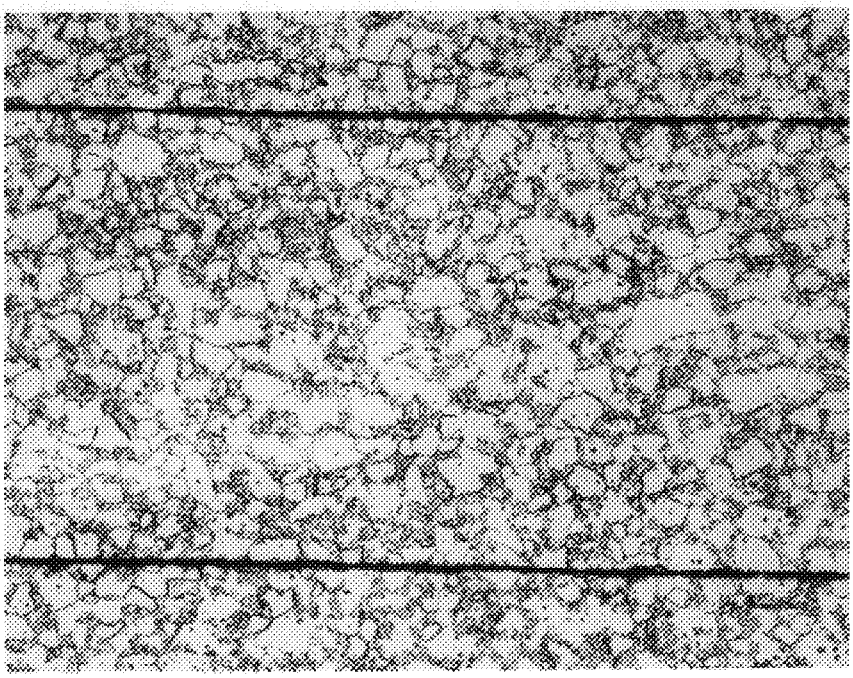
FIG. 2 is a photomicrograph at 200× magnification showing the microstructure of experimental sample #5 of Table 2.

FIG. 2 is a photomicrograph at 200X magnification illustrating the microstructure of Gleeble-annealed sample #5 that was annealed to an actual peak temperature of 1948° F. (1064° C.) with a 4 second TTT. The white areas in the photomicrograph are the ferrite matrix and the dark areas are the martensite phase. The martensite phase constitutes about 40% of the microstructure. It was determined that varying the aim temperature and TTT of the rapid annealing process in the temperature range investigated had no discernable effect on the metallographic structure of the alloy. Using an ASTM E112 Comparison Procedure, it was determined that the grain size of each Gleeble-annealed sample, regardless of the aim temperature and TTT, was substantially uniform at ASTM 9.0 (or 14 microns), with approximately 40% martensite in a ferrite matrix. It is believed that the ratio of martensite to ferrite achieved by the rapid annealing process of the present invention may be adjusted by manipulating the steel's chemical composition, and that further improvement in the steel's mechanical properties could be achieved in that way.

Although the eighteen Gleeble-annealed samples were air-cooled through radiation and air convection, it is contemplated that sheet or strip rapidly annealed by the present process may be cooled using any known cooling process that provides a cooling rate sufficient to transform austenite to martensite. The manner of cooling is not critical otherwise and may include natural convection, or forced convection using air, hydrogen, or inert gases, for example.

Figure 3:
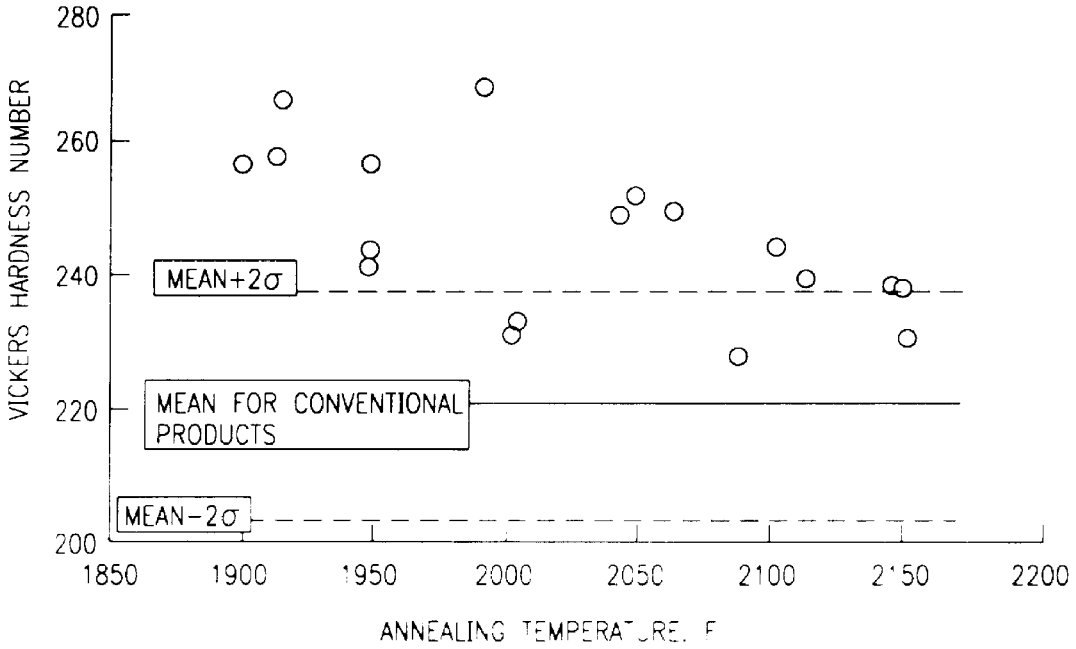
FIG. 3 is a plot of the average Vickers Hardness Number (VHN) as a function of actual peak annealing temperature for the experimental samples of Table 2 processed according to the method of the present invention.

FIG. 3 is a plot of the average Vickers Hardness Numbers (VHN) reported in Table 2 as a function of the peak annealing temperature. A Wilson Series 2000 instrument was used to measure VHN. FIG. 3 also includes an unbroken straight line plotted at the mean Vickers Hardness Number reported in Table 3 for conventionally annealed dual phase T-430 strip, and broken straight lines at plus and minus two standard deviations (mean+2σ and mean−2σ) from the mean Vickers Hardness Number of Table 3. It should be noted that although the solid and broken straight lines appear in FIG. 3, they should not be interpreted as being a function of the annealing temperatures provided on the X-axis. In each of the eighteen Gleeble-annealed samples, rapid annealing in the temperature range investigated produced dual phase ferrite-martensite material with hardness levels greater than the 221.4 VHN mean reported in Table 3 for the conventionally processed T-430 coils. The increase in hardness provided by the rapid annealing method of the present invention is particularly pronounced in the temperature range of 1900°–2000° F. (1038°–1260° C.), where hardness values up to 266 VHN were achieved.

Figure 4:
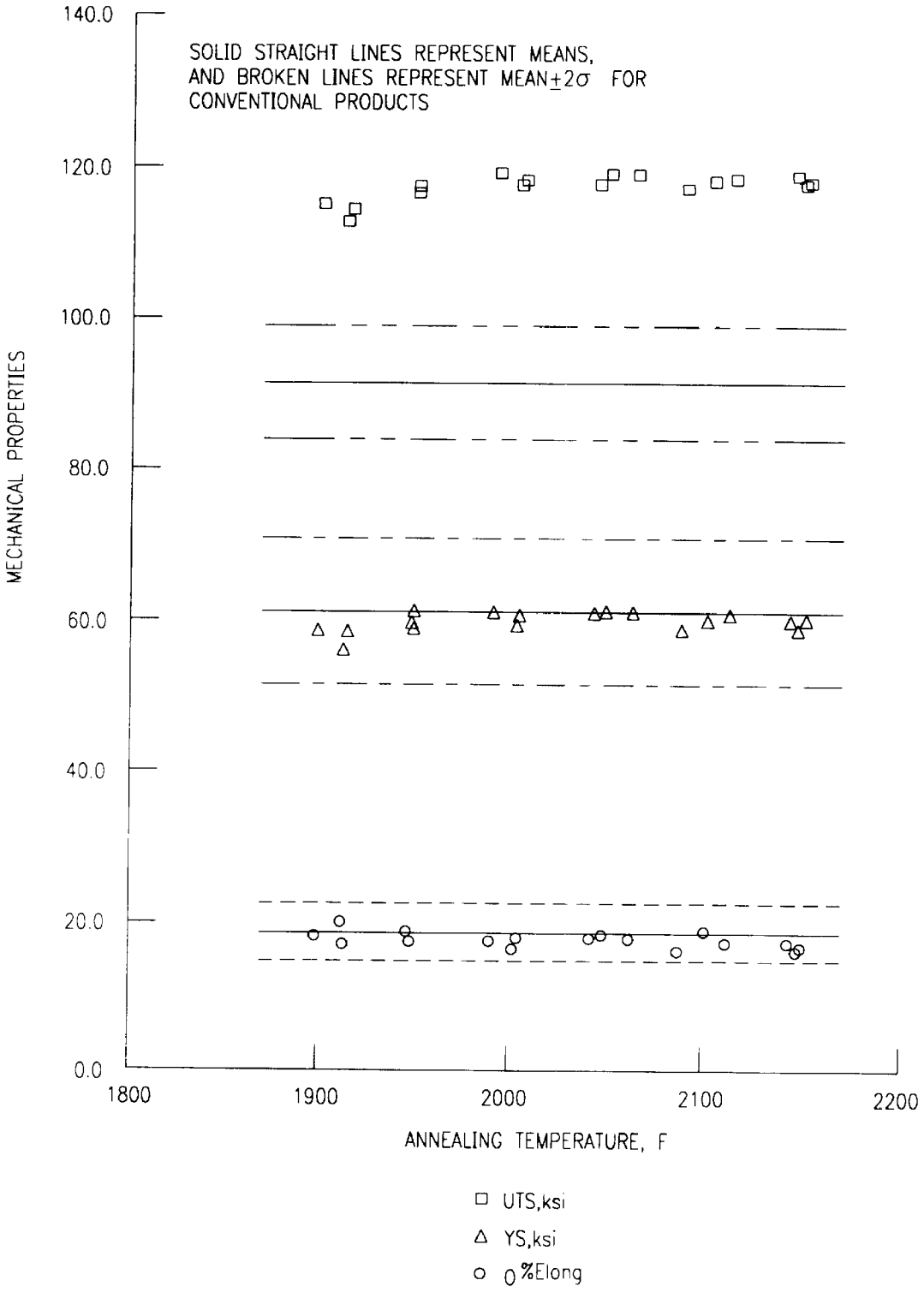
FIG. 4 is a plot of yield strengths, ultimate tensile strengths and percent elongations as a function of actual peak annealing temperature for the experimental samples of Table 2 processed according to the method of the present invention.

FIG. 4 is a plot of yield strengths, ultimate tensile strengths and percent elongations for each of the eighteen Gleeble-annealed samples as a function of actual peak annealing temperature. As in FIG. 3, the mean value of the mechanical properties from Table 3 for conventionally processed T-430 coil is plotted in FIG. 4 as a straight line and dotted lines indicate the mean value plus or minus two standard deviations (±2σ) for each property. FIG. 4 shows that the rapid annealing method of the present invention has increased the ultimate tensile strength of the Gleeble-annealed T-430 samples to an average of 117.4 ksi over the tested temperature range. This represents a 28.2% increase over the 91.6 ksi mean ultimate tensile strength reported in Table 3 for conventionally annealed dual phase T-430 product. FIG. 4 also shows that the increase in ultimate tensile strength was achieved by the present method without detrimentally affecting the yield strength and elongation of the strip relative to conventionally annealed dual phase T-430 product. All of the yield strength and elongation values collected from the Gleeble-annealed samples fell around the mean value from Table 3 and were within the +/−2σ boundaries calculated for the conventionally annealed dual phase T-430 product.

EXAMPLE 2

Additional TFIH annealing simulations were conducted in a manner similar to Example 1 for a similar T-430 steel for 16 coil samples from nine heats shown as Sample Nos. 19–34 of Table 4. The annealing cycles were rapid annealing to 2050° F. (1121° C.) at rates of TTT of 4 seconds. After heating to temperature, the samples were air cooled by radiation and convection to room temperature and then metallographically evaluated for grain size, % martensite and Vickers Hardness. In summary, the rapid annealing process of the present invention produced grain sizes in the range of ASTM 8.0–9.0, martensite in the range of 27–33% and Vickers Hardness averaging 224 VHN. Though slightly lower than the values of Example 1, the properties are still significantly better than the conventional properties.

TABLE 4

| Sample No. | Aim Temp. (°F.) | Actual Peak Temp. (°F.) | TTT (sec) | Grain Size (ASTM) | Martensite (%) | Hardness (VHN) |
|---|---|---|---|---|---|---|
| 19 | 2050 | 2050 | 4 | 8.0–8.5 | ~27 | 220 |
| 20 | 2050 | 2047 | 4 | 8.5–9.0 | ~32 | 226 |
| 21 | 2050 | 2031 | 4 | 8.5–9.0 | ~30 | 225 |
| 22 | 2050 | 2050 | 4 | 8.5–9.0 | ~30 | 224 |
| 23 | 2050 | 2048 | 4 | 8.5–9.0 | ~30 | 225 |
| 24 | 2050 | 2048 | 4 | 8.5 | ~30 | 228 |
| 25 | 2050 | 2052 | 4 | 8.5 | ~30 | 227 |
| 26 | 2050 | 2050 | 4 | 8.0–8.5 | ~30 | 220 |
| 27 | 2050 | 2063 | 4 | 8.0 | ~30 | 230 |
| 28 | 2050 | 2059 | 4 | 8.0 | ~30 | 229 |
| 29 | 2050 | 2051 | 4 | 8.0 | ~30 | 220 |
| 30 | 2050 | 2046 | 4 | 9.0 | ~30 | 221 |
| 31 | 2050 | 2052 | 4 | 8.5 | ~33 | 224 |
| 32 | 2050 | 2050 | 4 | 8.5 | ~30 | 217 |
| 33 | 2050 | 2057 | 4 | 8.5–9.0 | ~33 | 224 |
| 34 | 2050 | 2059 | 4 | 8.5–9.0 | ~33 | 228 |

The rapid annealing method of the present invention provides significant improvements in mechanical properties of dual phase ferrite-martensite stainless steel compared with dual phase material processed in a conventional manner. More specifically, the rapid annealing of T-430 steel in the temperature range of 1900°–2150° F. (1038°–1177° C.) will produce a dual phase ferrite-martensite product with uniformly distributed grains of ASTM 8–9 grain size and approximately 30–40% martensite. The dual phase T-430 product produced by the method of the present invention exhibits superior hardness (220–270 VHN) and superior tensile strength (112.9–119.3 ksi) with no detrimental effect on yield strength and elongation properties relative to conventionally processed T-430.

Although in the foregoing description of the preferred embodiment the rapid annealing method of the present invention has been applied to cold rolled T-430 ferritic strip, it is believed that sheet or strip of any suitable cold rolled stainless steel, including the AISI Type 400 series, may be subjected to the rapid annealing method of the present invention to provide a dual phase product consisting of ferrite and martensite and having improved mechanical properties relative to dual phase ferrite-martensite steel produced by a conventional annealing process. Accordingly, while the method of the present invention has been described in connection with the foregoing preferred embodiment, it is to be understood that method of the present invention may be applied to different starting materials and that modifications to the method described above may be present without departing from the scope of the present invention.

What is claimed:

1. A method for producing high tensile strength stainless steel sheet or strip consisting essentially of a dual phase of ferrite and martensite, the method comprising:

rapidly annealing cold rolled stainless steel by heating said stainless steel to an annealing temperature in less than 30 seconds; and cooling the heated steel at a cooling rate sufficient to transform austenite to martensite.

2. The method of claim 1 wherein after said cooling step the stainless steel sheet or strip exhibits increased tensile strength and hardness relative to conventionally produced stainless steel sheet or strip consisting essentially of a dual phase of ferrite and martensite.

3. The method of claim 1 wherein said annealing temperature is within the range of about 1900° F. (1038° C.) to about 2250° F. (1232° C.).

4. The method of claim 1 wherein in said rapid annealing step, the cold rolled stainless steel is heated to said annealing temperature in less than about ten seconds.

5. The method of claim 1 wherein in said rapid annealing step the heating rate is at least 200° F. per second (111° C. per second).

6. The method of claim 1 wherein in said rapid annealing step the heating rate is up to 1050° F. per second (583° C. per second).

7. The method of claim 1 wherein in said rapid annealing step the cold rolled stainless steel is heated by transverse flux induction heating.

8. The method of claim 1 wherein in said rapid annealing step, the cold rolled stainless steel is heated to said annealing temperature and then is subjected immediately to said cooling step after the steel reaches said annealing temperature.

9. The method of claim 2 wherein in said cooling step the cold rolled stainless steel is cooled at a cooling rate sufficient to provide the stainless steel with greater tensile strength and hardness with substantially the same yield strength and elongation relative to conventionally produced stainless steel sheet or strip consisting essentially of a dual phase of ferrite and martensite.

10. A method for producing high tensile strength stainless steel sheet or strip consisting essentially of a dual phase of ferrite and martensite, the method comprising:

rapidly annealing cold rolled stainless steel of the AISI 400 series by heating to an annealing temperature within the range of about 1900° F. (1038° C.) to about 2250° F. (1232° C.) at a heating rate of at least 200° F. per second (111° C. per second); and thereafter immediately cooling the heated steel from said annealing temperature in ambient air at a rate sufficient to transform austenite to martensite.

11. The method of claim 4 wherein in said rapid annealing step, the cold rolled stainless steel is heated to said annealing temperature and then is subjected immediately to said cooling step after the steel reaches said annealing temperature.

* * * * *